US006305347B1

(12) United States Patent
Russell

(10) Patent No.: US 6,305,347 B1
(45) Date of Patent: Oct. 23, 2001

(54) MONITOR FOR LEAN CAPABLE ENGINE

(75) Inventor: John David Russell, Farmington Hills, MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/518,890

(22) Filed: Mar. 6, 2000

(51) Int. Cl.[7] ..... F02B 17/00
(52) U.S. Cl. ..... 123/295; 123/430
(58) Field of Search ..... 123/295, 305, 123/430; 73/117.3; 60/274

(56) References Cited

U.S. PATENT DOCUMENTS 4,658,787 * 4/1987 Takizawa ..... 123/418
4,955,339 9/1990 Sasaki et al. ..... 123/295
5,241,855 * 9/1993 Cullen et al. ..... 73/117.3
5,692,472 12/1997 Bederna et al. ..... 123/350
5,755,198 5/1998 Grob et al. ..... 123/295
6,000,376 * 12/1999 Hess et al. ..... 123/333
6,006,717 * 12/1999 Suzuki et al. ..... 123/295
6,014,604 * 1/2000 Kuroiwa et al. ..... 701/54

* cited by examiner

*Primary Examiner*—Henry C. Yuen
*Assistant Examiner*—Mahamoud Gimie
(74) *Attorney, Agent, or Firm*—John D. Russell; Allan J. Lippa

(57) ABSTRACT

A method for monitoring a powertrain of a vehicle is described where powertrain output is estimated based on fuel when the powertrain operates lean of stoichiometry and powertrain output is estimated based on air when the powertrain operates rich of stoichiometry. Powetrain output is then compared with a preselected output and a reaction is initiated in response to the comparison.

23 Claims, 5 Drawing Sheets

MONITOR FOR LEAN CAPABLE ENGINE

FIELD OF THE INVENTION

The field of the invention relates to monitoring of electronically controlled drive units in vehicles.

BACKGROUND OF THE INVENTION

In some engines, an electronically controlled throttle is used for improved performance. In addition, engines may also be controlled using engine output, or torque control where the actual engine torque is controlled to a desired engine torque through an output adjusting device, such as with the electronic throttle, ignition timing, air-fuel ratio, or various other devices.

Also, engines using torque control and electronic throttles may also operate lean of stoichiometry to improve engine thermal efficiency and increase vehicle fuel economy. In these systems, the engine is operated lean of stoichiometry and relatively unthrottled, thereby decreasing engine pumping work and further increasing fuel efficiency. To increase the range of lean operation, direct injection can be used where fuel is injected directly into the engine.

Engines can also operate rich of stoichiometry. For example, rich operation may be required to purge stored emissions or to provide additional engine torque, as well as during various other situations.

One method to monitor engine control systems determines if actual engine torque is greater than desired engine torque. Actual engine torque is determined in accordance with engine airflow and/or injected fuel amount, and various other factors. Such a method is described in U.S. Pat. No. 5,692,472.

The inventors herein have recognized a disadvantage of the above approach. In particular, when such a method is utilized with engines that operate both lean of stoichiometry and rich of stoichiometry, differing torque estimates are produced depending on the operating state. Stated another way, when lean, engine torque determined from airflow is greater than engine torque determined from fuel injection amount. Similarly, when rich, engine torque determined from fuel injection amount is greater than engine torque determined from airflow. As such, engine torque may be over-estimated in one operating condition or another. Such over-estimation may degrade monitoring performance.

SUMMARY OF THE INVENTION

An object of the present invention is to provide methods for monitoring powertrains capable of operating rich of stoichiometry, near stoichiometry, and lean of stoichiometry.

The above object is achieved and disadvantages of prior approaches overcome by a method for monitoring a vehicle powertrain having an engine inducting air and fuel, the method comprising: determining a preselected powertrain output; calculating an actual powertrain output based on air when the powertrain is operating rich of stoichiometry; calculating said actual powertrain output based on fuel when the powertrain is operating lean of stoichiometry; and initiating a reaction when said actual powertrain output is greater than said preselected powertrain output.

By calculating powertrain output based on air when rich of stoichiometry and based on fuel when lean of stoichiometry, it is possible to obtain an accurate and robust estimate of powertrain output. In particular, in either lean or rich conditions, a relatively few number of parameters need be considered. Stated another way, excess parameters to modify estimates are minimized and robustness is achieved concurrently.

An advantage of the above aspect of the invention is improved monitoring.

Another advantage of the above aspect of the invention is that over-estimation can be minimized.

In another aspect of the present invention, the above object is achieved and disadvantages of prior approaches overcome by a monitoring system comprising: a powertrain having an engine inducting air and fuel, wherein said engine is a direct injection engine capable of operating both in a stratified and a homogeneous mode, said engine also capable of operating rich of stoichiometry, lean of stoichiometry, and substantially near stoichiometry; a powertrain monitor for monitoring an engine control system, said monitor determining a preselected powertrain torque, calculating an actual powertrain torque based on first and second independent signals indicative of air when said powertrain is operating rich of stoichiometry, calculating said actual powertrain torque based on third and fourth independent signals indicative of fuel when said powertrain is operating lean of stoichiometry, and initiating a reaction when said actual powertrain torque is greater than said preselected powertrain torque.

An advantage the above aspect of the invention is improved estimation through improved monitoring. In particular, by providing two estimates of fuel from independent sources for lean conditions and two estimates of air from independent sources for rich conditions, over-estimation can be minimized while providing redundancy.

BRIEF DESCRIPTION OF THE DRAWINGS

The object and advantages of the invention claimed herein will be more readily understood by reading an example of an embodiment in which the invention is used to advantage with reference to the following drawings wherein:

DESCRIPTION OF THE INVENTION

Figure 1:
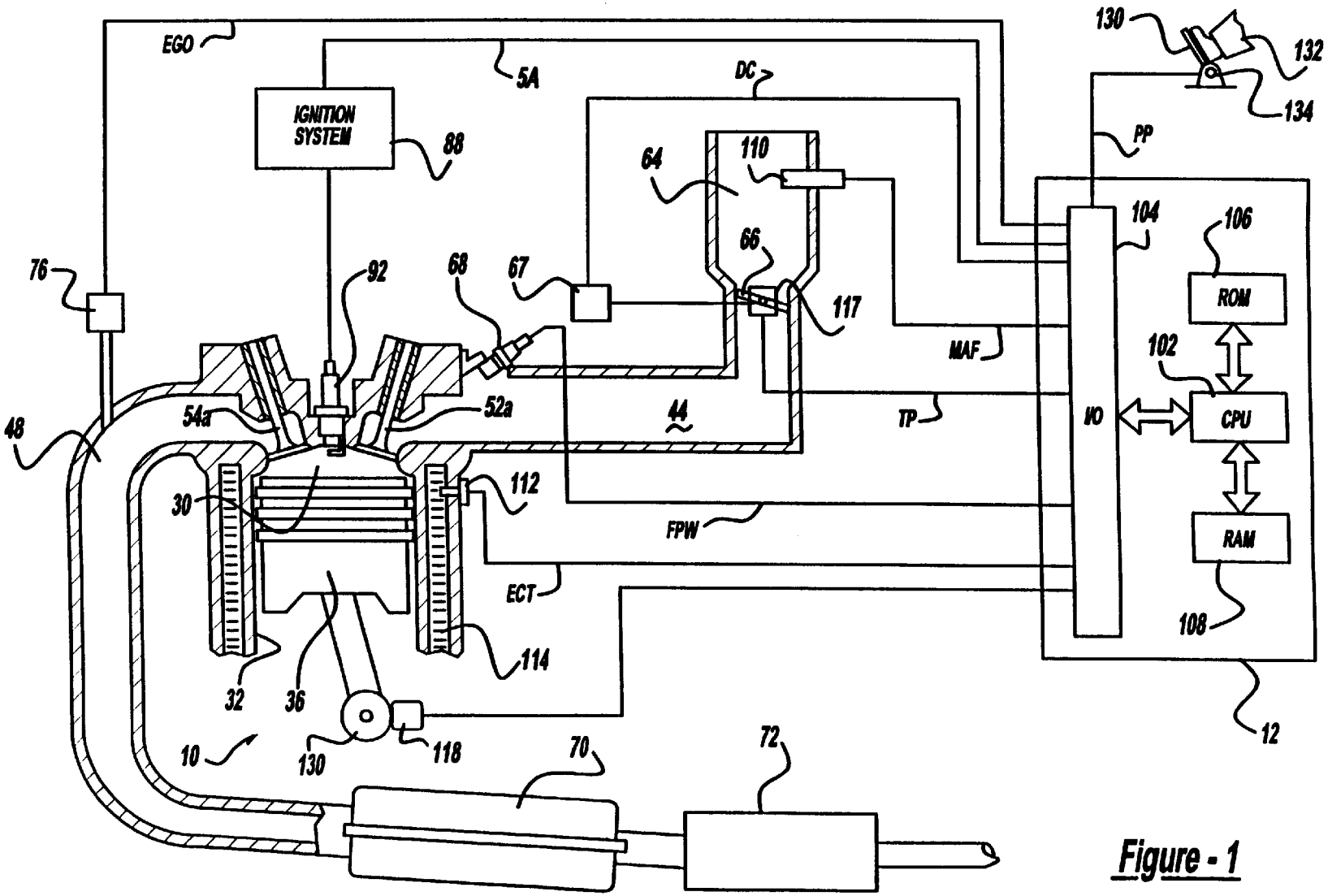
FIG. 1 is a block diagram of a vehicle illustrating various components related to the present invention.

Direct injection spark ignited internal combustion engine 10, comprising a plurality of combustion chambers, is controlled by electronic engine controller 12. Combustion chamber 30 of engine 10 is shown in FIG. 1 including combustion chamber walls 32 with piston 36 positioned therein and connected to crankshaft 40. In this particular example piston 36 includes a recess or bowl (not shown) to help in forming stratified charges of air and fuel. Combustion chamber, or cylinder, 30 is shown communicating with intake manifold 44 and exhaust manifold 48 via respective intake valves 52*a* and 52*b* (not shown), and exhaust valves 54*a* and 54*b* (not shown). Fuel injector 68 is shown directly coupled to combustion chamber 30 for delivering liquid fuel directly therein in proportion to the pulse width of signal fpw received from controller 12 via a conventional electronic driver. Fuel is delivered to fuel injector 68 by a conventional high pressure fuel system (not shown) including a fuel tank, fuel pumps, and a fuel rail.

Intake manifold 44 is shown communicating with throttle body 64 via throttle plate 66. In this particular example, throttle plate 66 is coupled to electric motor 67 so that the position of throttle plate 66 is controlled by controller 12 via electric motor 67. This configuration is commonly referred to as electronic throttle control (ETC) which is also utilized during idle speed control. In an alternative embodiment (not shown), which is well known to those skilled in the art, a bypass air passageway is arranged in parallel with throttle plate 66 to control inducted airflow during idle speed control via a throttle control valve positioned within the air passageway.

Exhaust gas oxygen sensor 76 is shown coupled to exhaust manifold 48 upstream of catalytic converter 70. In this particular example, sensor 76 provides signal EGO to controller 12 which converts signal EGO into two-state signal EGOS. A high voltage state of signal EGOS indicates exhaust gases are rich of stoichiometry and a low voltage state of signal EGOS indicates exhaust gases are lean of stoichiometry. Signal EGOS is used to advantage during feedback air/fuel control in a conventional manner to maintain average air/fuel at stoichiometry during the stoichiometric homogeneous mode of operation.

Conventional distributorless ignition system 88 provides ignition spark to combustion chamber 30 via spark plug 92 in response to spark advance signal SA from controller 12.

Controller 12 causes combustion chamber 30 to operate in either a homogeneous air/fuel mode or a stratified air/fuel mode by controlling injection timing. In the stratified mode, controller 12 activates fuel injector 68 during the engine compression stroke so that fuel is sprayed directly into the bowl of piston 36. Stratified air/fuel layers are thereby formed. The stratum closest to the spark plug contains a stoichiometric mixture or a mixture slightly rich of stoichiometry, and subsequent strata contain progressively leaner mixtures. During the homogeneous mode, controller 12 activates fuel injector 68 during the intake stroke so that a substantially homogeneous air/fuel mixture is formed when ignition power is supplied to spark plug 92 by ignition system 88. Controller 12 controls the amount of fuel delivered by fuel injector 68 so that the homogeneous air/fuel mixture in chamber 30 can be selected to be at stoichiometry, a value rich of stoichiometry, or a value lean of stoichiometry. The stratified air/fuel mixture will always be at a value lean of stoichiometry, the exact air/fuel being a function of the amount of fuel delivered to combustion chamber 30. An additional split mode of operation wherein additional fuel is injected during the exhaust stroke while operating in the stratified mode is also possible.

Nitrogen oxide (NOx) absorbent or trap 72 is shown positioned downstream of catalytic converter 70. NOx trap 72 absorbs NOx when engine 10 is operating lean of stoichiometry. The absorbed NOx is subsequently reacted with HC and catalyzed during a NOx purge cycle when controller 12 causes engine 10 to operate in either a rich homogeneous mode or a stoichiometric homogeneous mode.

Controller 12 is shown in FIG. 1 as a conventional microcomputer including: microprocessor unit 102, input/output ports 104, an electronic storage medium for executable programs and calibration values shown as read only memory chip 106 in this particular example, random access memory 108 and a conventional data bus. Controller 12 is shown receiving various signals from sensors coupled to engine 10, in addition to those signals previously discussed, including: measurement of inducted mass air flow (MAF) from mass air flow sensor 100 coupled to throttle body 64; engine coolant temperature (ECT) from temperature sensor 112 coupled to cooling sleeve 114; a profile ignition pickup signal (PIP) from Hall effect sensor 118 coupled to crankshaft 130; and throttle position TP from throttle position sensor 117; and absolute Manifold Pressure Signal MAP. Engine speed signal RPM is generated by controller 12 from signal PIP in a conventional manner and manifold pressure signal MAP provides an indication of engine load. In a preferred aspect of the present invention, sensor 118, which is also used as an engine speed sensor, produces a predetermined number of equally spaced pulses every revolution of the crankshaft.

In this particular example, temperature of catalytic converter 70 and temperature of NOx trap 72 are inferred from engine operation as disclosed in U.S. Pat. No. 5,414,994 the specification of which is incorporated herein by reference. In an alternate embodiment, these temperatures are provided by temperature sensors.

Figure 2:
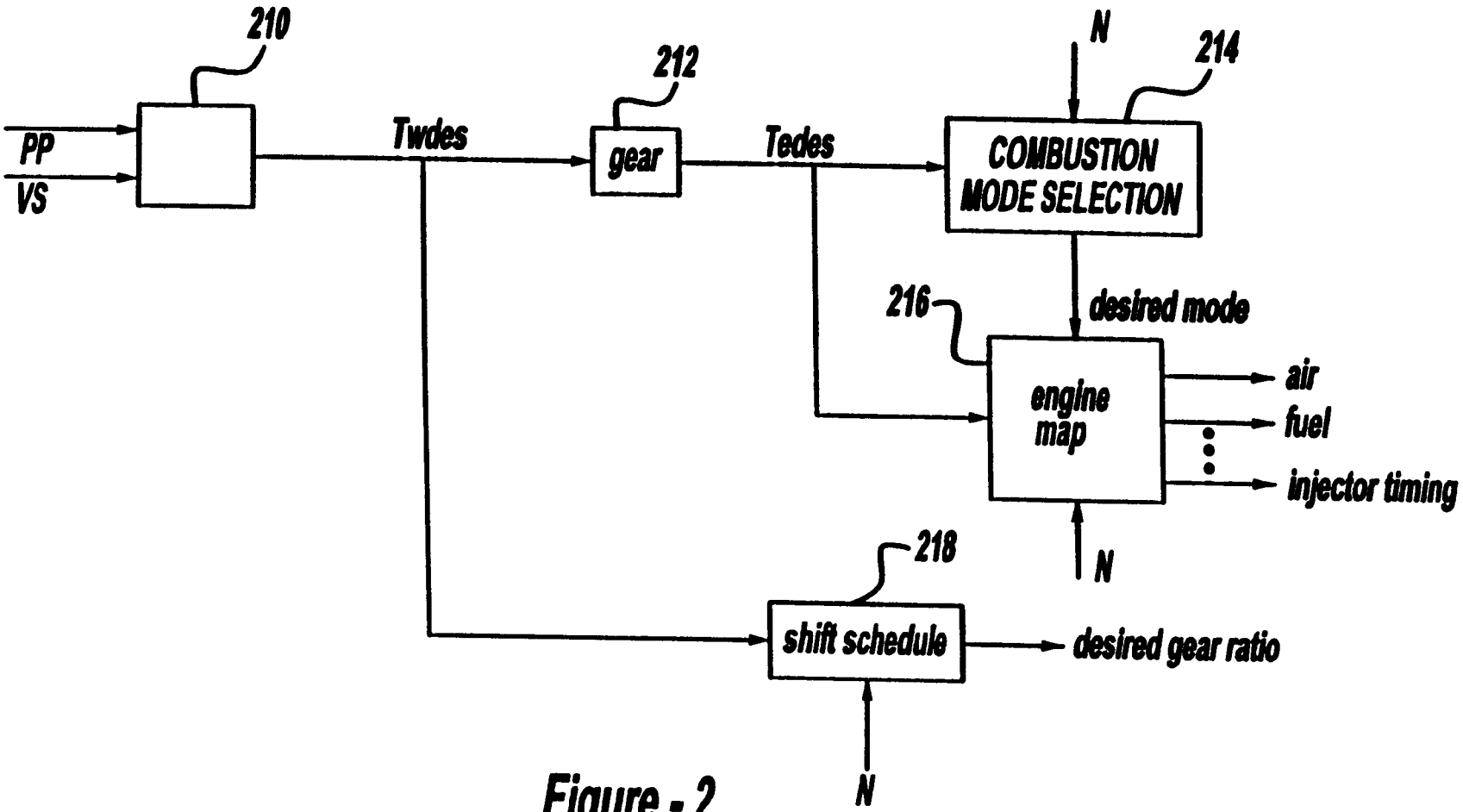
FIG. 2 is a block diagram of an engine control architecture in which the invention is used to advantage.

Referring now to FIG. 2, a block diagram of the torque based control system and direct injection mode selection system is shown. First, signals representing pedal position (PP) and vehicle speed (VS) are fed into block 210. Block 210 represents the driver demand tables that convert the pedal position and vehicle speed signals into a desired wheel torque (Twdes). Then, the desired wheel torque is multiplied by the gear ratio in block 212 to produce a desired engine torque (Tedes). From the desired engine torque and engine speed (N), a desired combustion mode is produced from block 214. In particular, block 214 represents a look-up table where desired torque and engine speed are used to select the most efficient combustion mode to produce minimum emissions with the optimum fuel economy. The desired mode selected is either a stratified mode where fuel is injected during the compression stroke, a split mode where fuel is injected both during the intake stroke and during the compression stroke, and perhaps additional times, or a homogeneous mode where fuel is injected in the intake stroke. Then, from the desired engine torque signal and the desired mode and engine speed, block 216 produces the desired settings for the actuators including air, fuel, injection timing, ignition timing, exhaust gas recirculation, variable cam timing, and any other actuator coupled to the powertrain. In particular, the engine map in block 216 produces settings for the parameters that will produce the optimum emissions and fuel economy given the desired engine torque in the selected mode. In this way, according to the present invention, no matter which mode is selected, the correct engine torque will be produced. Finally, from the desired wheel torque and engine speed, a desired gear ratio is selected using block 218, which represents shift schedules.

Fuel injector 68 (FIG. 1) is controlled to provide the desired fuel amount and electronic throttle 66, cam position (if equipped), and exhaust gas recirculation valve position (if equipped) are controlled to provide the desired air amount.

Figure 3:
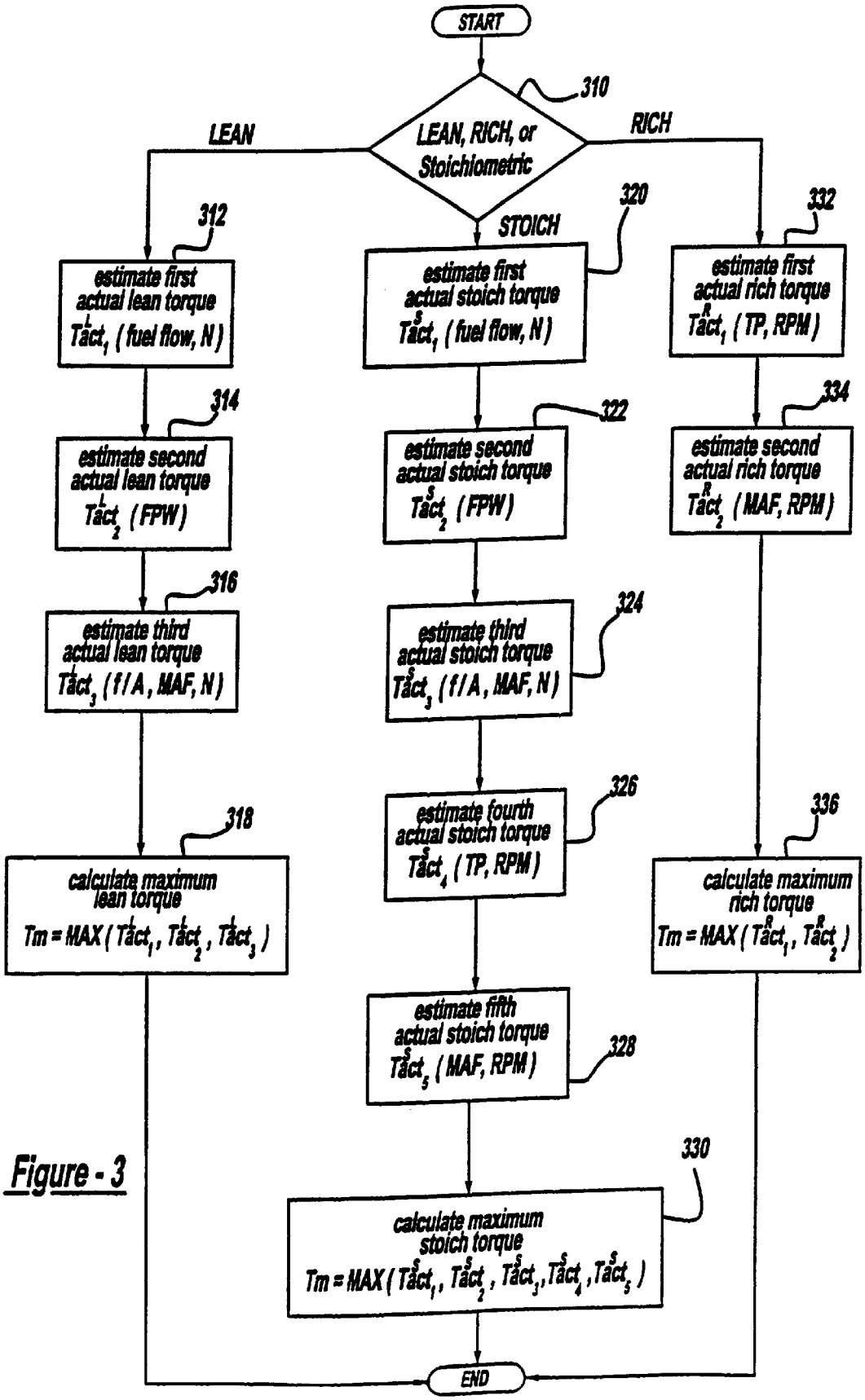
FIGS. 3–5 are block diagrams of embodiments in which the invention is used to advantage.

Referring now to FIG. 3, a routine is described for calculating actual engine torque to be used for monitoring the engine control system. First, in step 310, a determination is made as to whether the engine is currently operating lean of stoichiometry, rich of stoichiometry, or substantially at, or near, stoichiometry. Operating substantially at stoichiometry represents oscillating about stoichiometry in the conventional manner. The determination in step 310 is preferably made based on one or more exhaust gas sensors. For example, heated exhaust gas oxygen sensors (HEGO), universal exhaust gas oxygen sensors (UEGO), linear exhaust gas oxygen sensors, or any other exhaust sensor which indicates exhaust air/fuel ratio can be used. When the engine is operating lean of stoichiometry, the routine continues to step 312, where a first actual lean torque ($T^{L}act_1$) is calculated based on fuel flow and engine speed. Fuel flow is determined as described previously herein with respect to FIG. 1. Next, in step 314, the routine calculates a second actual lean torque ($T^1act_2$) based on fuel pulse width (fpw). Next, in step 316, the routine estimates a third actual lean torque ($T^1act_3$) based on fuel air ratio, mass air flow, and engine speed. Then, in step 318, the routine calculates a maximum lean torque (Tm) based on the maximum of the first, second and third actual lean torques. In an alternate embodiment, any two of the above three lean torque estimates can be used to calculate the maximum lean torque (Tm). In this way, independent sensors are used to calculate actual lean torque based on fuel when the engine is operating lean. The maximum of these estimates is used.

Continuing with FIG. 3, when the engine is operating substantially at stoichiometry in step 310, the routine continues to step 320 where the first actual stoichiometric torque ($T^Sact_1$) is calculated based on fuel flow and engine speed. In step 322, a second actual stoichiometric torque ($T^Sact_2$) is then calculated based on fuel pulse width. In step 324, a third actual stoichiometric torque ($T^Sact_3$) is then calculated based on fuel air ratio, mass air flow, and engine speed. In step 326, a fourth actual stoichiometric torque ($T^Sact_4$) is calculated based on throttle position and engine speed. If a variable cam timing system is used, position of the variable cam timing is taken into account to calculate the fourth actual stoichiometric torque. Finally, in step 328, a fifth actual stoichiometric torque is calculated ($T^Sact_5$) based on mass air flow and engine speed. Then, in step 330, the maximum stoichiometric torque (Tm) is calculated based on the maximum of the first through fifth actual stoichiometric torques. In an alternate embodiment, the maximum of any two of the above five estimated stoichiometric torques can be used. Stated another way, when operating near stoichiometry, either fuel, or air, or any combination of the two can be used. In this way, independent sensors can be used to provide estimates of actual engine torque and the maximum of these is then used in monitoring the engine.

Continuing with FIG. 3, when the engine is operating rich of stoichiometry, in step 310, the routine continues to step 332 where a first actual rich torque ($T^Ract_1$) is calculated based on throttle position and engine speed. If a variable cam timing system is used, position of the variable cam timing system is also taken into account to calculate the first actual rich torque. Next, in step 334, a second actual rich torque is calculated ($T^ract_2$) based on mass air flow and engine speed. Then, in step 336, a maximum rich torque (Tm) is calculated as the maximum of the first and second actual rich torques. In this way, independent sensors are used to calculate actual engine torque. The maximum of these torques is then used in monitoring the engine.

As described above herein, in particular reference to FIG. 3, the routine calculates engine torque based on fuel when the engine is operating lean since excess air present does not burn and does not contribute to producing engine torque. In this way, an accurate and robust estimate of engine torque is provided when operating lean. Similarly, when the engine is operating rich, actual engine torque is calculated based on parameters indicative of air, since excess fuel does not burn and does not contribute to producing engine torque. When the engine is operating near stoichiometry, any combination of the lean or rich estimates can be used since all of the air and all the fuel each burn and contribute to producing engine torque. Another advantage of such an approach is that any degradation in the exhaust gas sensor(s) used to indicate whether the engine is lean or rich of stoichiometry inherently leads to a conservative estimate. For example, if the engine is actually operating lean and a rich indication is given from the sensor, torque may be calculated from air. However, this torque will be greater than torque from fuel since, by definition, excess air is present when lean. Similarly, if the engine is actually operating rich and a lean indication is given from the sensor, torque may be calculated from fuel. However, this torque will be greater than torque from air since, by definition, excess fuel is present when rich.

Figure 4:
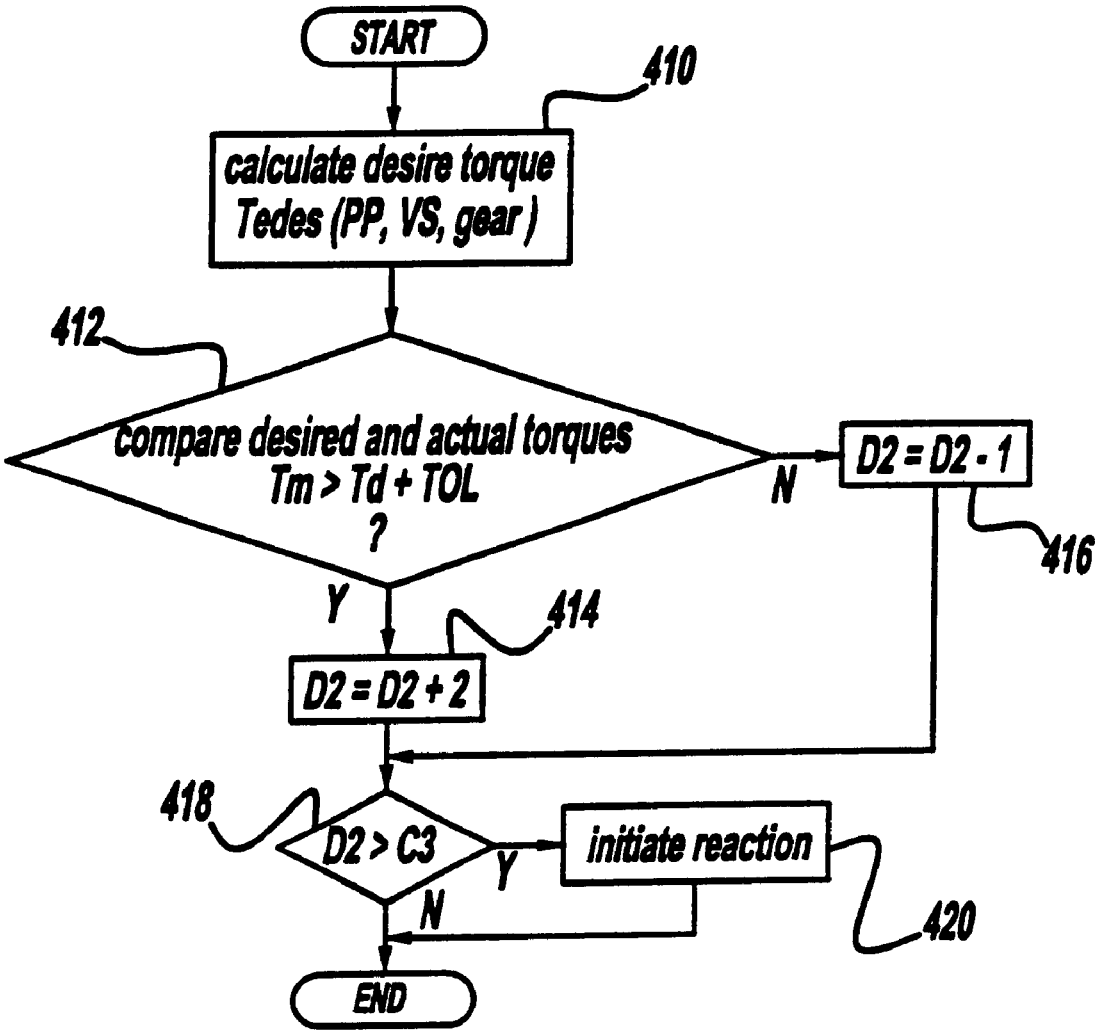

Referring now to FIG. 4, a routine is described for monitoring the engine based on the maximum torque (Tm) calculated in FIG. 3. First, in step 410, the desired engine torque (Tedes) is calculated as described previously herein with respect to FIG. 2. This desired engine torque represents the preselected engine torque. However, there can be other sources of the preselected engine torque such as, for example, engine idle speed control, traction control, cruise control, and various other sources known to those skilled in the art. In step 412, the desired and actual torques are compared using a tolerance (TOL). If the maximum torque (Tm) is greater than the sum of the actual allowable torque and tolerance, the routine continues to step 414 where counter D2 is incremented by two. Otherwise, in step 416, counter D2 is decremented by one. Then, in step 418, a determination is made as to whether counter D2 is greater than limit value C3. When the answer to step 418 is YES, the routine continues to step 420 where a reaction is initiated. This reaction is in a preferable embodiment, decreasing engine torque. Engine torque can be decreased in a variety of methods, including decreasing fuel amount, decreasing air amount, retarding ignition timing, deactivating cylinders, or any other method known to those skilled in the art in view of this disclosure to reduce engine torque. Also, a reaction can be changing a transmission gear ratio to produce less wheel torque or engaging ancillary devices to consume engine torque. Thus, according to the present invention, it is possible to monitor engine 10. Also, in an alternative embodiment, wheel torques can be used in place of engine torques in steps 410 and 412. In particular, desired wheel torque can be found directly from pedal position and vehicle speed. Then, in step 412, maximum torque (Tm) is used with gear ratio and torque converter torque ratio to find actual maximum wheel torque.

Figure 5:
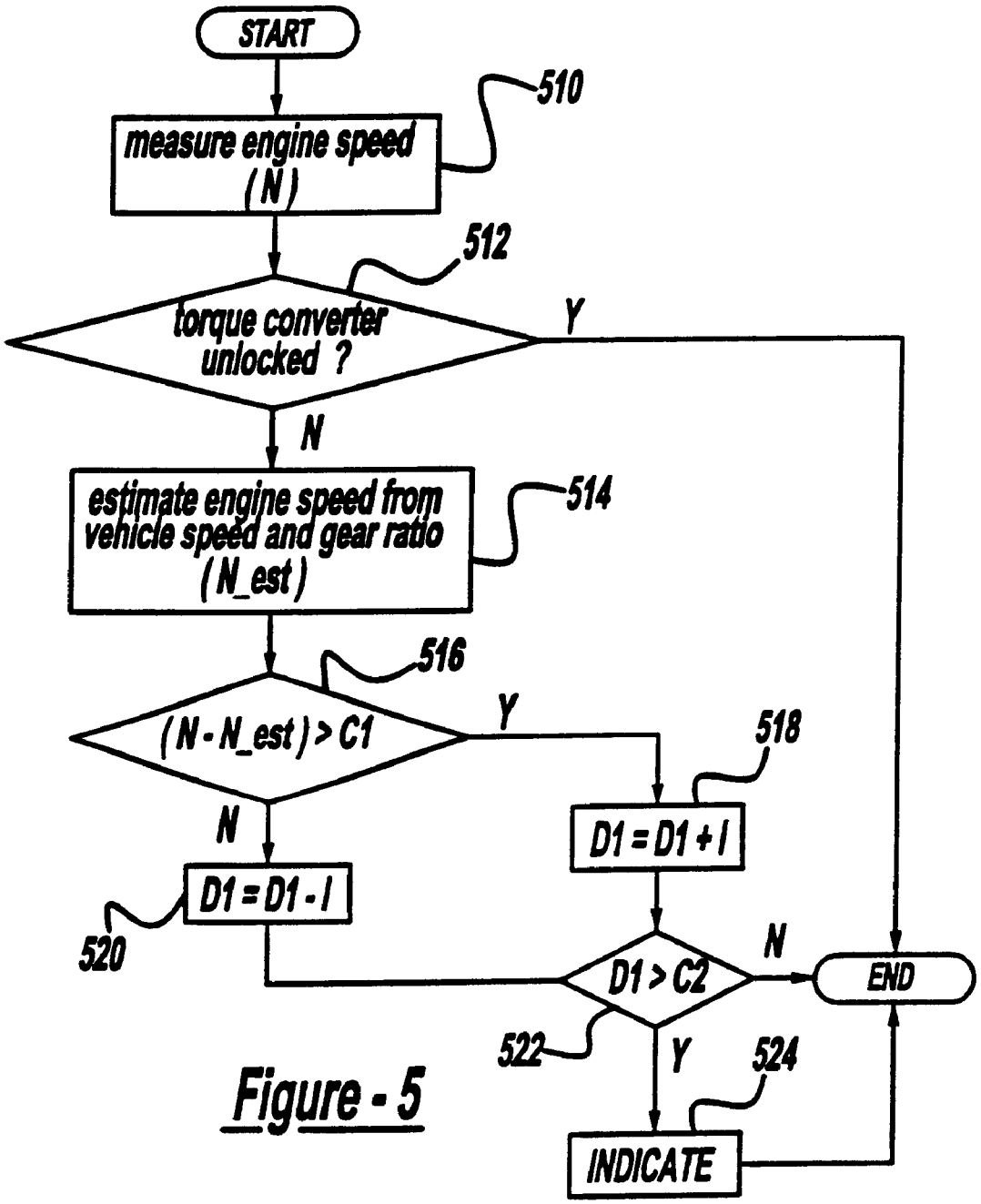

Referring now to FIG. 5, a routine is described for monitoring engine speed sensing. First, in step 510, engine speed is measured. Then, in step 512, a determination is made as to whether the torque converter is unlocked. When the answer to step 512 is NO, the routine estimates engine speed (N_est) from a vehicle speed sensor (VS) and gear ratio in step 514. Then, in step 516, a determination is made as to whether the difference between the measured engine speed (N) and estimated engine speed (N_est) is greater than limit value C1. When the answer to step 516 is YES, the routine continues to step 518 where counter D1 is incremented by one. Otherwise, the routine continues to step 520 where counter D1 is decremented by one. Then, in step 522, counter D1 is compared to threshold limit value C2. When counter D1 is greater than C2, the routine indicates this in step 524. In response to this indication, the engine controller may provide a reduced engine function.

Although several examples of embodiments which practice the invention have been described herein, there are numerous other examples which could also be described. For example, the invention can also be used with hybrid electric vehicles using lean operating engines. The invention is therefore to be defined only in accordance with the following claims.

I claim:

1. A method for monitoring a vehicle powertrain having an engine inducting air and fuel, the method comprising:

determining a preselected powertrain output;

calculating an actual powertrain output based on air when the powertrain is operating rich of stoichiometry;

calculating said actual powertrain output based on fuel when the powertrain is operating lean of stoichiometry; and initiating a reaction when said actual powertrain output is greater than said preselected powertrain output.

2. The method recited in claim 1 wherein said powertrain comprises an engine.

3. The method recited in claim 1 wherein said powertrain comprises an engine and a transmission.

4. The method recited in claim 1 wherein said powertrain output comprises an engine torque.

5. The method recited in claim 1 further comprising:

indicating the powertrain is operating lean of stoichiometry based on an exhaust sensor; and indicating the powertrain is operating rich of stoichiometry based on said exhaust sensor.

6. The method recited in claim 1 wherein said step of calculating said actual powertrain output based on air further comprises calculating an actual powertrain torque based on a maximum of air from a throttle position and air from an airflow sensor.

7. The method recited in claim 1 wherein said step of calculating said actual powertrain output based on fuel further comprises calculating an actual powertrain torque based on a maximum of fuel from a fuel injector pulse width and fuel from a fuel flow sensor.

8. The method recited in claim 1 wherein said powertrain output is a wheel torque.

9. The method recited in claim 2 wherein said powertrain output is an engine torque.

10. A monitoring system comprising:

a powertrain having an engine inducting air and fuel, wherein said engine is a direct injection engine capable of operating both in a stratified and a homogeneous mode, said engine also capable of operating rich of stoichiometry, lean of stoichiometry, and substantially near stoichiometry;

a powertrain monitor for monitoring an engine control system, said monitor determining a preselected powertrain torque, calculating an actual powertrain torque based on first and second independent signals indicative of air when said powertrain is operating rich of stoichiometry, calculating said actual powertrain torque based on third and fourth independent signals indicative of fuel when said powertrain is operating lean of stoichiometry, and initiating a reaction when said actual powertrain torque is greater than said preselected powertrain torque.

11. The monitoring system recited in claim 10 wherein said powertrain monitor further calculates said actual powertrain torque based on a maximum of a first torque indicated by said first signal and second torque indicated by said second signal.

12. The method recited in claim 11 wherein said first signal is a throttle position of a throttle coupled to said engine.

13. The method recited in claim 11 wherein said first signal is a mass air flow from a mass air flow sensor.

14. The monitoring system recited in claim 10 wherein said powertrain monitor further calculates said actual powertrain torque based on a maximum of a third torque indicated by said third signal and fourth torque indicated by said fourth signal.

15. The method recited in claim 14 wherein said third signal is a fuel pulse width of a fuel injected coupled to said engine.

16. The method recited in claim 14 wherein said fourth signal is a fuel flow from a fuel flow sensor coupled in a fuel system of said engine.

17. An article of manufacture comprising:

a computer storage medium having a computer program encoded therein for monitoring a vehicle powertrain having an engine inducting air and fuel, said computer storage medium comprising:

code for determining a preselected powertrain torque;

code for calculating an actual powertrain torque based on air when the powertrain is operating rich of stoichiometry;

code for calculating said actual powertrain torque based on fuel when the powertrain is operating lean of stoichiometry; and code for initiating a reaction when said actual powertrain torque is greater than said preselected powertrain torque.

18. The article recited in claim 17 wherein said code for initiating a reaction further comprises code for reducing powertrain output.

19. The article recited in claim 18 wherein said code for initiating a reaction further comprises code for changing a transmission gear ratio.

20. The article recited in claim 18 wherein said code for initiating a reaction further comprises code for reducing engine torque.

21. The article recited in claim 18 wherein said code for initiating a reaction further comprises code for engaging ancillary devices.

22. A method for monitoring and controlling a vehicle powertrain having an engine inducting air and fuel, the method comprising:

determining a desired torque;

selecting a combustion mode based on said desired torque;

determining setting for an actuator coupled to the engine based on said selected combustion mode and said desired torque;

controlling said actuator in response to said setting;

calculating an actual powertrain torque based on air when the powertrain is operating rich of stoichiometry and based on fuel when the powertrain is operating lean of stoichiometry; and initiating a reaction when said actual powertrain output is greater than said preselected powertrain output.

23. The method recited in claim 22 wherein said torque is a wheel torque.

* * * * *